United States Patent [19]

Neu

[11] Patent Number: 5,030,495

[45] Date of Patent: Jul. 9, 1991

[54] TEMPERATURE CONTROLLED SHEET

[76] Inventor: Stephen T. Neu, 39 Pebble Hill Rd., Fairport, N.Y. 14450

[21] Appl. No.: 393,288

[22] Filed: Aug. 14, 1989

[51] Int. Cl.[5] ..... B32B 1/04; A47C 27/00

[52] U.S. Cl. ..... 428/76; 428/137; 428/138; 428/166; 428/172; 428/178; 428/188; 428/212; 428/224; 428/284; 428/287; 428/913; 5/449; 5/455; 5/461; 5/468; 5/471

[58] Field of Search ..... 428/188, 76, 136, 172, 428/166, 158, 219, 72, 178, 68, 131, 137, 138, 212, 219, 224, 284, 287, 286, 248, 340, 913; 5/455, 449, 448, 450, 461, 468, 471

[56] References Cited

U.S. PATENT DOCUMENTS 4,132,577 1/1979 Wintermantel ..... 428/188
4,549,323 10/1985 Brockhaus ..... 428/72

*Primary Examiner*—Ellis P. Robinson
*Assistant Examiner*—Donald J. Loney
*Attorney, Agent, or Firm*—Howard J. Greenwald

[57] ABSTRACT

A temperature controlled cover is disclosed. The cover contains a sheet and several fluid channels.

The cover is air-permeable, containing at least 50 percent of textile material and from about 1 to about 30 percent of polymeric material (the fluid channels).

The fluid channels contain orifices which communicate with the channels; and conditioned air passing through the channels thus escapes through the orifices. The channels are bonded to the top sheet.

20 Claims, 2 Drawing Sheets

TEMPERATURE CONTROLLED SHEET

FIELD OF THE INVENTION

An sheet through which conditioned air may be passed to cool or heat a body is contact with the sheeting material.

BACKGROUND OF THE INVENTION

Electric blankets are in wide use, especially in northern climates. However, there is a substantial body of evidence indicating that the electromagnetic fields created by the use of these blankets may be injurious to the health of those using them. Furthermore, these blankets are limited in function, only being able to heat a person's body. To applicant's knowledge, no practical means has been provided for cooling a sleeper's body with a relatively lightweight, comfortable sheeting medium.

U.S. Pat. No. 4,653,130 of Senoue et al. describes an air mattress containing a multiplicity of pneumatically expandible and contractible air venting cells. The air mattress of this patent is made from either an elastic plastic or natural rubber material (see column 3) and, thus, is not readily usuable directly in contact with the skin of a user; furthermore, because of its weight, lack of flexibility, and impermeability to air it cannot safely and readily be draped over a user to cover him without undue risk of suffocation.

U.S. Pat. No. 3,778,851 of Howorth describes a mattress consisting essentially of air-impermeable material such as, e.g., flexible, synthetic plastic material; see, e.g., column 2. This mattress suffers from all of the disadvantages mentioned above for the mattress of Senoue et al. Furthermore, the venting channels used in the mattress of Howorth must contain foamed plastic material, the use of which substantially increases the weight of the mattress and decreases both its flexibility and its ability to conduct conditioned air.

It is an object of this invention to provide a temperature controlled sheeting material which can readily and safely be used to cover a person's body without causing discomfort or creating a risk of suffocation.

It is a further object of this invention to provide a sheet material which is relatively flexible and lightweight and, thus, may be wrapped around the body of a person.

It is yet another object of this invention to provide a temperature controlled sheet which has a relatively simple design and, thus, is relatively inexpensive.

It is yet another object of this invention to provide a temperature controlled sheet which, when in contact with the body of a person, is substantially more comfortable than the prior art temperature controlled matresses.

SUMMARY OF THE INVENTION

In accordance with this invention, there is provided a temperature controlled sheet for covering a person's body comprised of a top textile material, a bottom textile material, and a multiplicity of fluid channels disposed between the top and bottom textile material and continguous with each of such textile materials. The sheet comprises at least 50 weight percent of air permeable textile material. Each fluid channel contains a multiplicity of venting orifices which communicate with the interior portion of either the top or the bottom textile material.

DESCRIPTION OF THE DRAWINGS

The present invention will be more fully understood by reference to the following detailed description thereof, when read in conjunction with the attached drawings, wherein like reference numerals refer to like elements and wherein.

DESCRIPTION OF THE PREFERRED EMBODIMENTS

Figure 1:
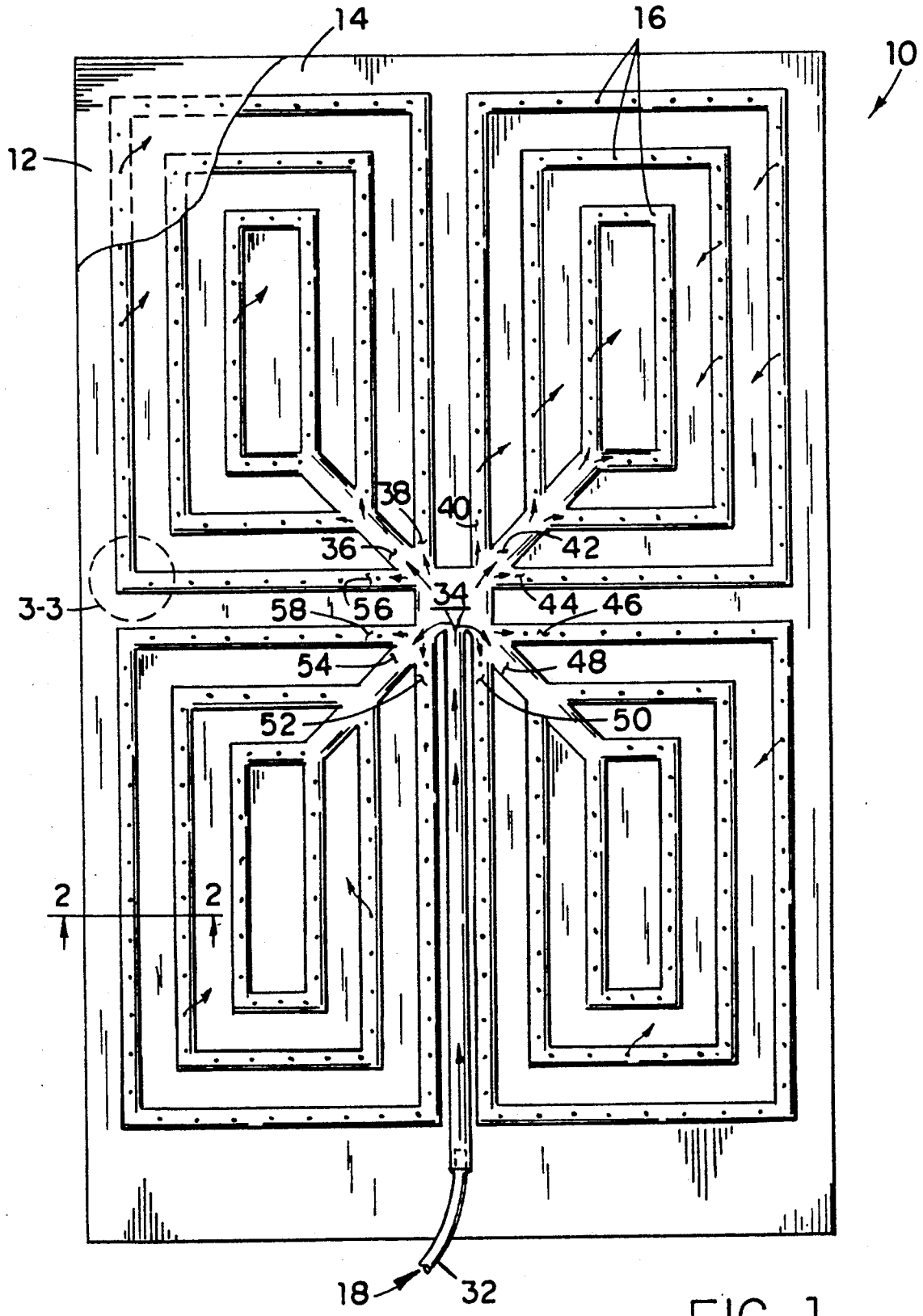
FIG. 1 is a top view of a preferred embodiment of the temperature controlled sheet of the invention.

Applicant's temperature controlled sheet 10 is illustrated in FIG. 1. As is shown in the preferred embodiment of FIG. 1, sheet 10 is comprised of a first piece of textile material 12, a second piece of textile material 14, a multiplicity of fluid channels 16 for conveying conditioned air, a source of conditioned air 18, and means 20 for distributing said conditioned air between said fluid channels 16.

Applicant's temperature controlled sheet 10 is comprised of both permeable and non-permeable materials. As used in this specification, the term permeable refers to a material which, under ordinary ambient conditions, allows the passage of air therethrough. See, for example, A.S.T.M. Standard Test D737 (07.01), the disclosure of which is hereby incorporated by reference into this specification. Also see the permeability values of typical materials reported in Joseph F. Hanlon's "Handbook of Package Engineering", Second Edition (McGraw-Hill Inc., New York, 1971), pages 13-6 to 13-17, the disclosure of which is hereby incorporated by reference into this specification. Thus, by way of illustration, suitable permeable materials which may be used in applicant's sheet include textile materials conventionally used in sheets and blankets such as, e.g., cotton, wool, polyester, nylon, acrylic resin, and the like. See, e.g., pages 547-560 of Volume 13 of the McGraw Hill Encyclopedia of Science and Technology (McGraw-Hill Book Company, New York, 1977), the disclosure of which is hereby incorporated by reference into this specification.

The non-permeable material(s) used in applicant's sheet 10 will preferably comprise or consist essentially of one or more plastic materials. These plastic materials are well known to those skilled in the art and are disclosed, e.g., in Brage Golding's "Polymers and Resins" (D. Van Nostrand Company, Inc., Princeton, New Jersey, 1959), the disclosure of which is hereby incorporated by reference into this specification.

In one preferred embodiment, at least 50 percent; by weight, of sheet 10 is comprised of one or more permeable materials. It is preferred that least 70 weight percent of said sheet be comprised of air permeable material. In an even more preferred embodiment, at least about 90 weight percent of said sheet is comprised of permeable material.

The first piece of textile material 12 and the second piece of textile material 14 may be of any size, shape, weight, and type of fabric. As is known to those skilled in the art, they may be comprised of woven fabrics, which are comprised of webs of fiber yarns. The yarns may be of either filament (continuous) or staple (short) fibers; and they are preferably interlaced at right angles to each other to produce the web. See, e.g., pages 300–301 of Brady & Clauser's "Materials Handbook," Twelfth Edition (McGraw-Hill Book Company, New York, 1986), the disclosure of which is hereby incorporated by reference into this specification.

In one preferred embodiment, each of textile pieces 10 and 12 are substantially rectilinear.

In addition to the first piece of textile material 12 and the second piece of textile material 14, sheet 10 is also comprised of a multiplicity of fluid channels 16; the fluid these channels is designed to convey is conditioned air, which often will be at a temperature different than ambient. These fluid channels, which preferably comprise less than about 50 weight percent of said sheet 10, preferably consist of one or more plastic materials.

Figure 2:
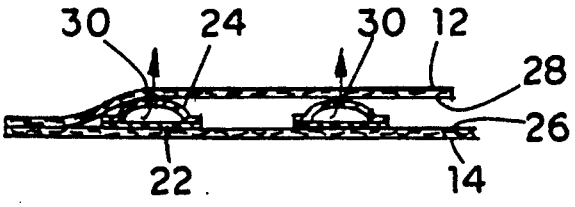
FIG. 2 is a partial sectional view of the sheet of FIG. 1.
Figure 3:
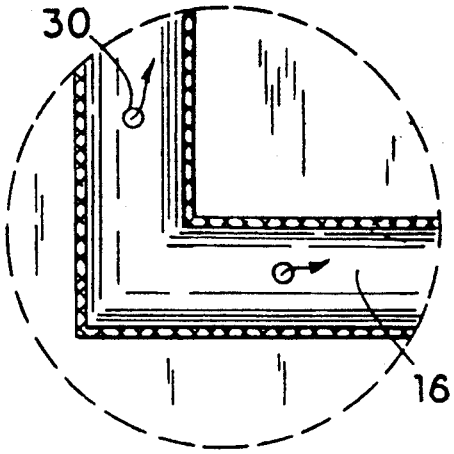
FIG. 3 is a partial top view of the fluid channels comprising the sheet of FIG. 1.

A cross-sectional view of applicant's sheet 2 is shown in FIG. 2. Referring to FIG. 2, it may be seen that each channel 16 is comprised of a bottom wall 22 and top wall 24 which, in the preferred embodiment shown, are joined to each other to define the channel. The sheet 10 contains a multiplicity of these channels. The total surface area of the channels 16 is preferably no greater than about 50 percent of the surface area of textiles 12 and 14.

In the preferred embodiment illustrated in FIG. 2, each of the channels is contiguous with both textile 12 and textile 14. In one preferred embodiment, each of the channels 16 is also attached to both textile 12 and textile 14.

In one embodiment, the bottom wall 22 of channel is attached to the top surface of textile 14 by means well known to those skilled in the art. In one embodiment, a strip of plastic material corresponding to channel bottom wall 22 is zone applied on the top surface 26 of textile 14, a strip of plastic material corresponding to channel top wall 24 may be zone applied on the bottom surface 28 of textile material 12, and the resultant textile materials are then joined to each other by means such as heat sealing, ultrasound, etc.

In another embodiment, the bottom wall of channel is adhesively bound to the top surface 26 of textile 14.

Figure 4:
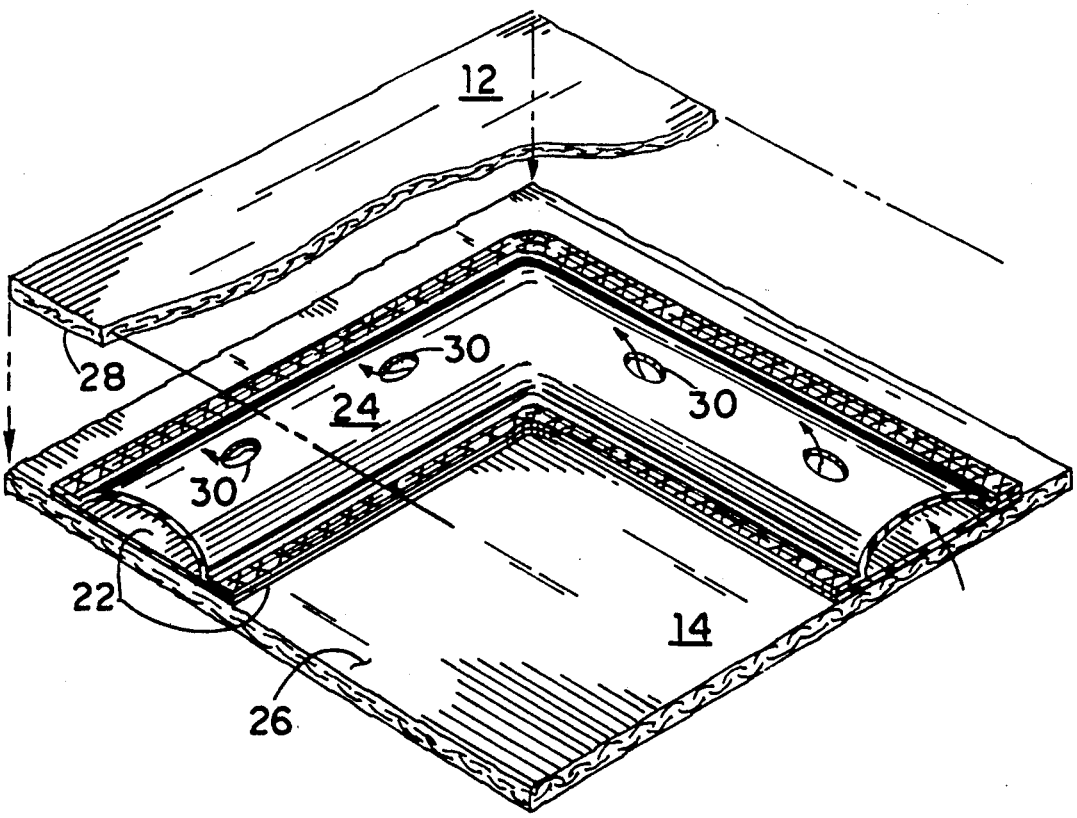
FIG. 4 is a broken-away, isometric view of the sheet of FIG. 1.

Each of the channels 16 is comprised of a multiplicity of venting orifices 30 through which the conditioned air may flow. In the preferred embodiment illustrated in FIG. 4, each of orifices 30 are on the same side of the channel 16. Thus, in FIG. 4, each of orifices 30 are on the top surface 24 of the channel. In another embodiment, not shown, each of orifices 30 are on the bottom surface 22 of channel 16. In yet another embodiment, orifices 30 are on both the top surface 24 and the bottom surface 22 of channel 16.

Each of the orifices 30 communicates with an interior surface of textile material 12 or textile material 14. Thus, in the embodiment illustrated in FIG. 4, each of orifices 30 communicates with the bottom surface 28 of textile material 12.

In one preferred embodiment, the channel is attached to the textile material by direct lamination coating. The five basic methods of laminating are well known to those skilled in the art and are described, e.g., on pages 13-9 to 13-10 of said "Handbook of Package Engineering," supra. In this embodiment, one uses a process involving solvent adhesives, which require evaporation for their effectiveness, and which, after evaporation, deposit a polymeric material upon the textile.

In the preferred solvent adhesive lamination process, a gravure coater is used for direct gravure coating. As is known to those in the art, in direct gravure coating the coating is picked up by impressions engraved in a metal roll. The excess is wiped off the smooth, nonengraved areas by a thin doctor blade. A back-up roll presses the web against the gravure cylinder, and the coated pattern is transferred to the web; the coating then flows together to provide uniform coverage. See, e.g., pages 123–125 of R. C. Griffin Jr.'s "Principles of Package Development," Second Edition (AVI Publishing Company, Inc., Westport, Conn., 1985), the disclosure of which is hereby incorporated by reference into this case.

In this preferred process, instead of using ink on the gravure, applicant preferably uses a material which, upon evaporation of the solvent of of which it is comprised, deposits produces a polymeric material. In one preferred embodiment, once the solvent has evaporated, the polymeric material on the textile is selected from the group consisting of polyvinylidene chloride, ethylene vinyl acetate, cellulose acetate, polyester, polypropylene, polyvinyl chloride, rubber hydrochloride, and the like. See, .e.g., the materials listed on page 13-11 of said "Handbook of Package Engineering," supra.

In one preferred embodiment, the material deposited after evaporation of the solvent is low density polyethylene (LDPE). As is known to those in the art, low density polyethylene has a density of from about 0.91 to about 0.925; see, e.g., Brady & Clausner's "Materials Handbook," supra. The properties of LDPE are described, e.g., on pages 57–61 of "The 1985 Packaging Encylopedia," Cahners Publishing, Boston, Mass.

It is preferred to deposit a polymeric coating upon the textile which has a thickness of from about 0.001 inches to about 0.04 inches and, more preferably, from about 0.001 to about 0.008 inches.

In this embodiment, after the polymeric material has been deposited upon the textile by the aforementioned gravure lamination method, a substantially identical, mirror-image deposit is made upon another textile material.

The textile materials upon which the polymeric material has been deposited must be permeable. Each of these textile materials thus must have a multiplicity of venting holes in them. Thus, each of the textile materials has a multiplicity of holes inserted in it. In one embodiment, the holes extend though the polymeric material deposited upon the textile. In another embodiment, the holes extend through both said polymeric material and the textile material.

It is preferred that the holes extending through the polymeric material and/or the textile material be relatively small, usually on the order of from about 0.01 to about 0.001 inches in diameter. A sufficient number of holes should be present in the material(s) to provide adequate ventilation. In one preferred embodiment, there are about 4 holes per square inch of material.

Thereafter, one or both of such ventilated textile materials (the "top") is placed with its deposited material in contact with the deposited material on the other of said textile materials (the "bottom"), and the top and bottom textile sheets are then joined together by heat sealing, whereby the deposited materials fuse together. In one preferred embodiment, either the top or the bottom, but not both, of the sheets are ventilated.

As is known to those skilled in the art, the welding or heat sealing of plastics is a method of joining them by heat and pressure applied in the area to be joined. The procedures include welding by conduction, radiation, friction, hot gas, high-frequency heating, impulse heating, ultrasonic irradiation, and lasers. See, for example, J. Stepek et al., "Polymers as Materials for Packaging," (Ellis Horwood Limited, Chicester, England, 1987), pages 399–410, the disclosure of which is hereby incorporated by reference into this case.

It is preferred to seal the plastics together by the application of ultrasound; see, e.g., pages 408–409 of said Stepek et al. book. In this embodiment, the textile materials are aligned with their respective polymeric portions contiguous with each other, and the ultrasound waves penetrate through the materials to the surfaces to be joined. As soon as the ultrasonic waves begin to penetrate through the joint (weld) into the other material, their source is switched off.

The welded sheet is then preferably cut to size and/or sewn around its perimeter.

Applicant's device preferably comprises a multiplicity of fluid channels 16, which may be produced on and bonded to the textile materials in the manner described above. It is preferred that at least one of said channels is contiguous with said textile material at at least one point along at least about 80 percent of the length of the textile material. It is to be understood that the channels need not be continuous, that they may be connected to one or several sources of conditioned air, that they may be in patterns substantially different than those disclosed in FIG. 1, etc. All that is required is that, if one calculates the total length of those portions of the textile material which have a channel in contact therewith somewhere across their width, such total length will be at least 80 percent of the length of the textile material.

The channels 16, which preferably consist essentially of polymeric material (such as plastic), usually comprise from about 1 to about 30 weight percent of the total weight of the temperature controlled sheet. It is preferred that the channels 16 comprise from about 5 to about 15 weight percent of the total weight of the sheet.

In one preferred embodiment, any source of conditioned air may be used as source of air 18. Thus, e.g., one may use an air pump such as, e.g., the air pump described in U.S. Pat. No. 4,653,130; conventional means for cooling and/or heating air may be used in conjunction with such air pump. Thus, e.g., one may use conventional driers, compressors, and the like.

Conventional means for distibuting air among the fluid channels 16 may be used. Thus, e.g., in the embodiment illustrated in FIG. 1, tube 32 conveys conditioned air to junction point 34, at which point the air distributes into the mouths 36, 38, 40, 42, 44, 46, 48, 50, 52, 54, 56, and 58 of channels 16. Other means of distributing air known to those skilled in the art also may be used.

The following example is presented to illustrate the claimed invention but is not to be deemed limitative thereof. Unless otherwise specified, all parts are by weight and all temperatures are in degrees centrigrade.

EXAMPLE 1

In accordance with the gravure lamination process described in the specification, a temperature controlled sheet is prepared. The textile material is roll of a polyester/cotton fabric obtainable from Burlington Fabrics. The plastic material deposited upon the textile material is a solution of low density polyethylene obtainable from Allied Chemical Company of Midland, Mich.; a sufficient amount of this solution is deposited so that, after evaporation of solvent but before heat sealing, the thickness of the polyethylene on each textile material is from about 0.002" to about 0.008". One of the coated textile materials has 4 holes per inch die punched thorugh it. Thereafter the sheet so ventilated (the top sheet) is joined to the other (bottom) sheet by fusing the plastic materials together by ultrasound. The edges of the fused sheet are sewn together.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

Thus, one may have an embodiment which is comprised of only one sheet of material. Such an embodiment may be prepared by depositing the polymeric material upon a sheetin accordance with the gravure lamination method described in the specification. However, after this sheet upon which polymer has been deposited is provided, one may then bond this sheet to a second sheet of thermoplastic material, thereby forming the fluid channels. The structure thus formed, even though it is only comprised of one sheet of material, is operative.

Thus, one may puncture the sheet containing the textile material and the plastic material so that the orifice extends through one or both of the sheets used in a two-sheet embodiment. Alternatively, one may choose to puncture only thorugh the first sheet. What is required, however, is that the orifice extend through at least the outer surface of the plastic channel to the inner surface of the plastic channel and, preferably, to the inner surface of the sheet.

In one embodiment, one may use two pieces of plastic film on a sheet. In this embodiment, outlines of the fluid channels 16 are cut into each of the films. Thereafter, one of the pieces of film is bonded to the textile material, and the surplus material which is not needed to define the channels is then removed by tearing it away. Thereafter, the second film, which also may have perforations outlining the channels patterns in it, is aligned with the sheet and bonded thereto. Thereafter, the surplus material from the second film may be removed from the sheet, leaving the formed channels. Perforations may be placed in the first or second film either before and/or after the film is attached either to the textile material and/or to the other film.

I claim:

1. A flexible temperature controlled cover for covering a person's body comprised of a sheet with a top surface, at least one interior element, and a bottom surface, a multiplicity of fluid channels for conveying conditioned air which are contiguous with at least one of said interior elements of said sheet, and means for distributing conditioned air to said fluid channels, wherein:

(a) at least about 70 weight percent of said cover is comprised of woven textile material;

(b) said cover is comprised of from about 1 to about 30 weight percent of a polymeric material;

(c) the interior surface of each of said fluid channels defines a passageway for the conveyance of conditioned air;

(d) each of said fluid channels is comprised of a multiplicity of orifices which extend from the exterior to the interior surfaces of the fluid channel and which communicate with said passageway;

(e) said fluid channels comprise from about 1 to about 30 weight percent of the total weight of said cover; and (f) said bottom surface of said sheet consists essentially of textile material.

2. The temperature controlled cover as recited in claim 1, wherein said cover is comprised of a top sheet, a bottom sheet, means for connecting said top sheet to said bottom sheet, and a multiplicity of fluid channels for conveying conditioned air which are disposed between said top sheet and said bottom sheet.

3. The temperature controlled cover as recited in claim 2, wherein at least about 70 weight percent of each of said top sheet and said bottom sheet is comprised of woven textile material.

4. The temperature controlled cover as recited in claim 3, wherein said woven textile material is selected from the group consisting of cotton, wool, polyester, nylon, acrylic resin, and mixtures thereof.

5. The temperature controlled cover as recited in claim 4, wherein at least about 90 weight percent of said cover is comprised of woven textile material.

6. The temperature controlled cover as recited in claim 5, wherein each of said top cover and said bottom cover are substantially rectilinear.

7. The temperature controlled cover as recited in claim 6, wherein each of said top sheet and said bottom sheet is contiguous with and bonded to said fluid channels.

8. The temperature controlled cover as recited in claim 7, wherein said polymeric material is selected from the group consisting of polyvinylidene chloride, ethylene vinyl acetate, cellulose acetate, polyester, polypropylene, polyvinyl chloride, rubber hydrochloride, and polyethylene.

9. The temperature controlled cover as recited in claim 8, wherein said polymeric material is polyethylene.

10. The temperature controlled cover as recited in claim 9, wherein said polyethylene has a density of from about 0.91 to about 0.925.

11. The temperature controlled cover as recited in claim 10, wherein each said orifices in said fluid channels is from about 0.01 to about 0.001 inches in diameter.

12. The temperature controlled cover as recited in claim 11, wherein said top sheet and said bottom sheet are sewn to each other.

13. The temperature controlled cover as recited in claim 12, wherein said cover comprises from about 5 to about 15 weight percent of said polyethylene.

14. The temperature controlled cover as recited in claim 13, wherein said said top sheet is comprised of at least about 90 weight percent of a textile material consisting of a blend of polyester and cellulosic fiber.

15. The temperature controlled cover as recited in claim 14, wherein said said bottom sheet is comprised of at least about 90 weight percent of a textile material consisting of a blend of polyester and cellulosic fiber.

16. The temperature controlled cover as recited in claim 15, wherein said cellulosic fiber is cotton.

17. The temperature controlled cover as recited in claim 15, wherein said cellulosic fiber is wool.

18. The temperature controlled cover as recited in claim 15, wherein each of said fluid channels has about 4 of said orifices per inch of its length.

19. The temperature controlled cover as recited in claim 13, wherein said said top sheet is comprised of at least about 90 weight percent of a textile material consisting of nylon fiber.

20. The temperature controlled cover as recited in claim 13, wherein said top sheet is comprised of at least about 90 weight percent of a textile material consisting of acrylic fiber.

* * * * *